United States Patent [19]

Grell

[11] 4,369,642

[45] Jan. 25, 1983

[54] DETAINED KEY ASSEMBLY

[75] Inventor: Gary J. Grell, Bellflower, Calif.

[73] Assignee: Norris Industries, Inc., Long Beach, Calif.

[21] Appl. No.: 247,381

[22] Filed: Mar. 25, 1981

[51] Int. Cl.[3] ..... E05B 11/00

[52] U.S. Cl. ..... 70/389; 70/380

[58] Field of Search ..... 70/120, 134, 379 R, 70/380, 389

[56] References Cited

U.S. PATENT DOCUMENTS

| | | | |
|---|---|---|---|
| 2,910,860 | 11/1959 | Cambe | 70/360 |
| 3,670,955 | 6/1972 | Dominick | 232/7 |
| 3,729,964 | 5/1973 | Hso | 70/389 |
| 4,109,496 | 8/1978 | Allemann | 70/389 |
| 4,254,648 | 3/1981 | Dietrich | 70/389 |

*Primary Examiner*—Robert L. Wolfe

*Attorney, Agent, or Firm*—Vernon D. Beehler

[57] ABSTRACT

A deadlock of the customary type for locking and unlocking a dead bolt is equipped with a conventional cylinder having a cylinder plug rotating within it, the cylinder plug carrying pin chambers aligned with pin chambers in the cylinder for reception of pin tumblers when shifted in position by cut irregularities on the edge of the key. With chambers in alignment an appropriate key inserted in the keyway shifts the pin tumblers to positions coincident with a shear line to permit rotation of the plug to either locked or unlocked position. Unless the chambers are in alignment, the tumblers cannot shift and the key can be neither inserted nor withdrawn. For preventing withdrawal of the key on, for example, the inside of the door, when the dead bolt is locked, there is a detained key mechanism. The mechanism makes use of one cam element on the cylinder plug moving with relation to another cam element on the cylinder so that with cam elements released in locked position of the dead bolt, a slight axial shift of the cylinder plug is permitted sufficient to misalign the chambers and prohibit withdrawal of the key. When the plug is returned to unlocked position, engagement of the cams prevents the slight axial shift of the cylinder plug thereby holding the chambers in alignment so that the pin tumblers can shift and the key can be withdrawn.

7 Claims, 12 Drawing Figures

Fig. 1.
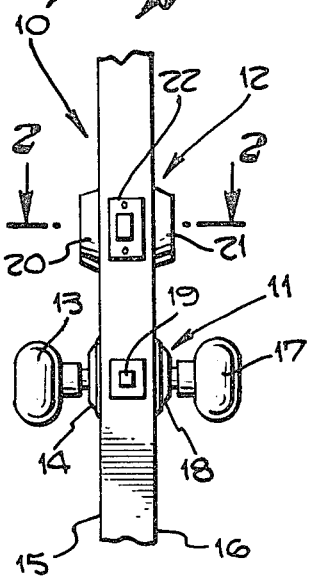
Fig. 2.
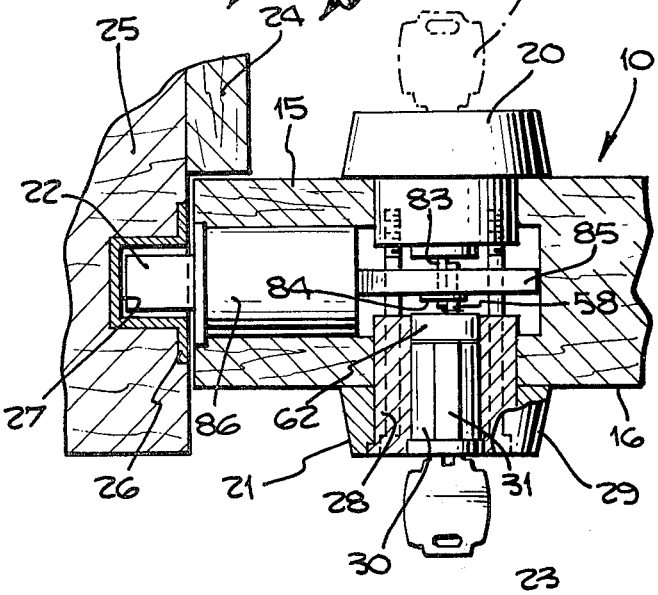
Fig. 3.
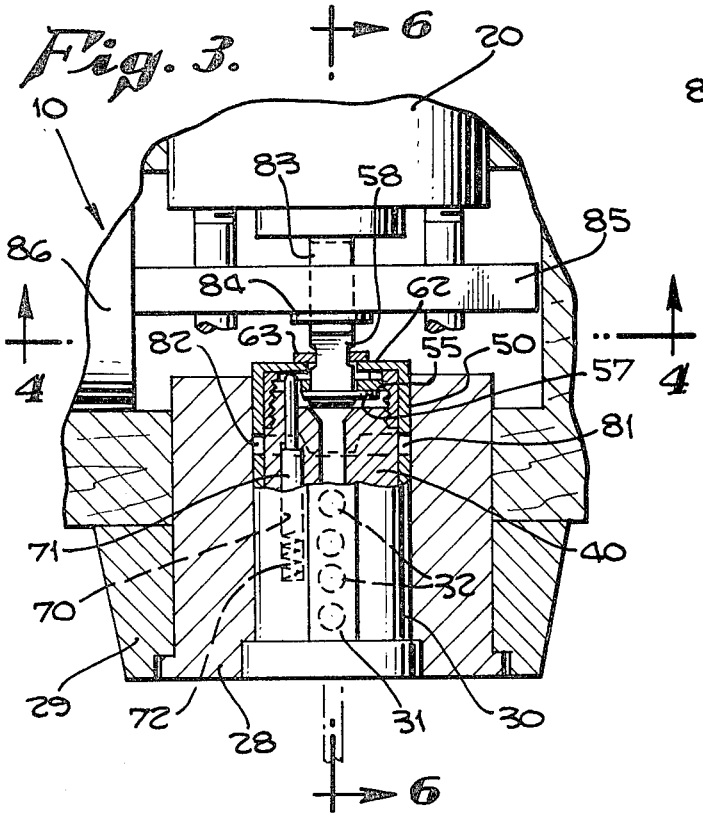
Fig. 4
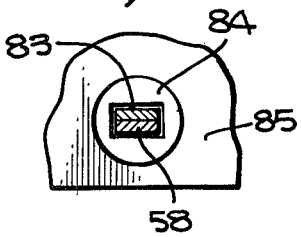
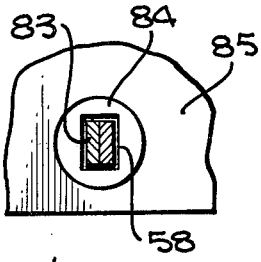
Fig. 5.

Fig. 6.
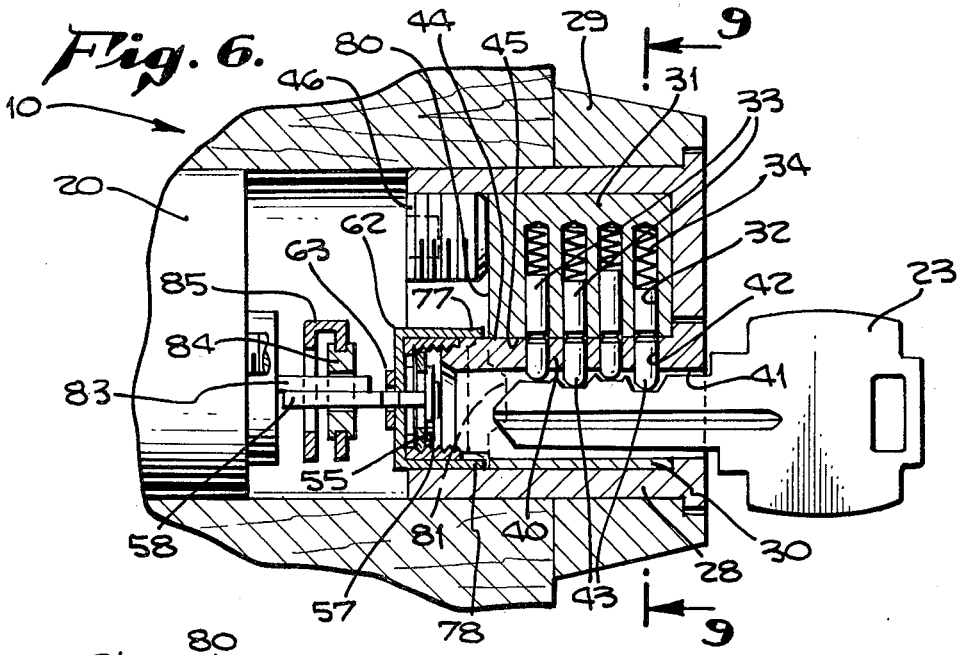
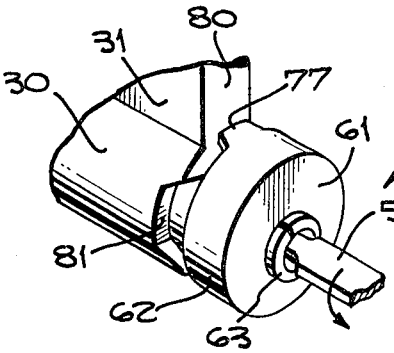
Fig. 7.
Fig. 8.
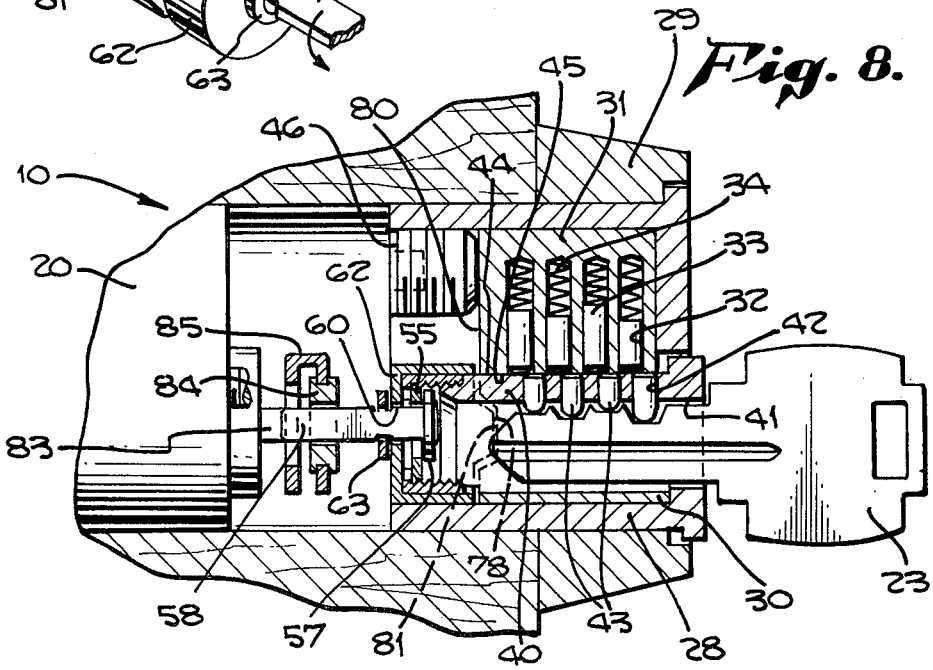

DETAINED KEY ASSEMBLY

A common added security measure for locking doors is employment of a deadlock in addition to the customary key in knob latch bolt mechanism. Such deadlock mechanisms are normally key actuated on the outside of the door and on the inside of the door are provided with a thumbturn for extending the dead bolt to locked position and withdrawing it to unlocked position.

One objection to the thumbturn lock set is that it allows an intruder, once entry has been made by other means, to simply open the main entrance door and by that expedient permit easy exit with large, bulky articles which could not be as easily removed otherwise. To remedy such situations, resort has been had to employment of a key actuated mechanism on the inside of a door instead of the customary thumbturn. Such an expedient effectively prevents an intruder from opening the main entrance door from the inside, even after entry has been made by some other means, in the absence of a key which fits the installation. Accordingly, bulky articles are more difficult to remove.

There are, however, serious objections to a key actuated mechanism on the inside of the door because it presents a safety hazard to the occupant. As an example, in the event of fire, with the dead bolt mechanism extended to locked position, and the key withdrawn from the lock and placed elsewhere, it is a very likely possibility that a panic situation would exist because of the difficulty in finding the key under the stress of circumstances. Such a situation could result in disaster.

Even under those circumstances where the proper key might be readily accessible, it may not be easy in the dark to locate the keyhole, especially, for example, in case of fire, where the occupant may be handicapped with smoke.

Although detention expedients for use with key actuated mechanisms on the inside of the door have been devised, they have frequently been found unnecessarily complicated and very frequently of such character as to add appreciably to the already high cost of the extra deadlock on the door.

It is therefore among the objects of the invention to provide a deadlock of substantially the customary type for added security which has the convenience of a thumbturn on the inside of the door or, in other words, the inner trim, thereby making it possible for the occupant to exit under all conditions, but which preserves the security barring against exit by unauthorized persons when the occupant is not on the premises.

Another object of the invention is to provide a new and improved deadlock such that the key actuated mechanisms remain of substantially conventional construction with only a modest modification being needed to trap the key in the lock when the locking bolt is extended to locked position by an occupant who remains inside the premises.

Still another object of the invention is to provide a new and improved deadlock operable on the inside trim with a keyed cylinder wherein the key is detained in the cylinder as long as the door remains locked but wherein those portions of the deadlock contributing to the detention of the key are relatively simple expedients making the arrangement possible without adding appreciably to the cost.

Still further among the objects of the invention is to provide a new and improved deadlock with a keyed cylinder on the inside trim incorporating means for detaining the key in the cylinder as long as the dead bolt remains in extended locked position but wherein the deadlock can readily be unlocked by use of a comparable key applied to the outside trim, irrespective of whether the inside key operated mechanism is in locked or unlocked position.

Also among the objects of the invention is to provide in a deadlock device a key operated mechanism and installation identical to most of the currently available double cylinder locks in which, while incorporating a key detention expedient, has no special handling requirements, which retains door thickness adjustments for standard doors, does not compromise the strength of existing cylinders, and requires no special key blank or key cuts.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 1 is an end elevational view of a fragment of door showing a conventional latch set, and a deadlock above it, as they are customarily located when in use.

FIG. 2 is a cross-sectional view on the line 2—2 of FIG. 1.

FIG. 3 is a fragmentary cross-sectional view of the inner trim of FIG. 2 with portions of the key actuated mechanism partly broken away.

FIG. 4 is a fragmentary cross-sectional view on the line 4—4 of FIG. 3 with the dead bolt in retracted unlocked position.

FIG. 5 is a fragmentary cross-sectional view similar to FIG. 4 with the dead bolt in extended locked position.

FIG. 6 is a fragmentary vertical cross-sectional view on the line 6—6 of FIG. 3 with the dead bolt in unlocked position.

FIG. 7 is a fragmentary end perspective view of the cylinder.

FIG. 8 is a fragmentary vertical sectional view, similar to FIG. 6 but with the dead bolt in locked position.

Figures 9, 10, 11, 12:
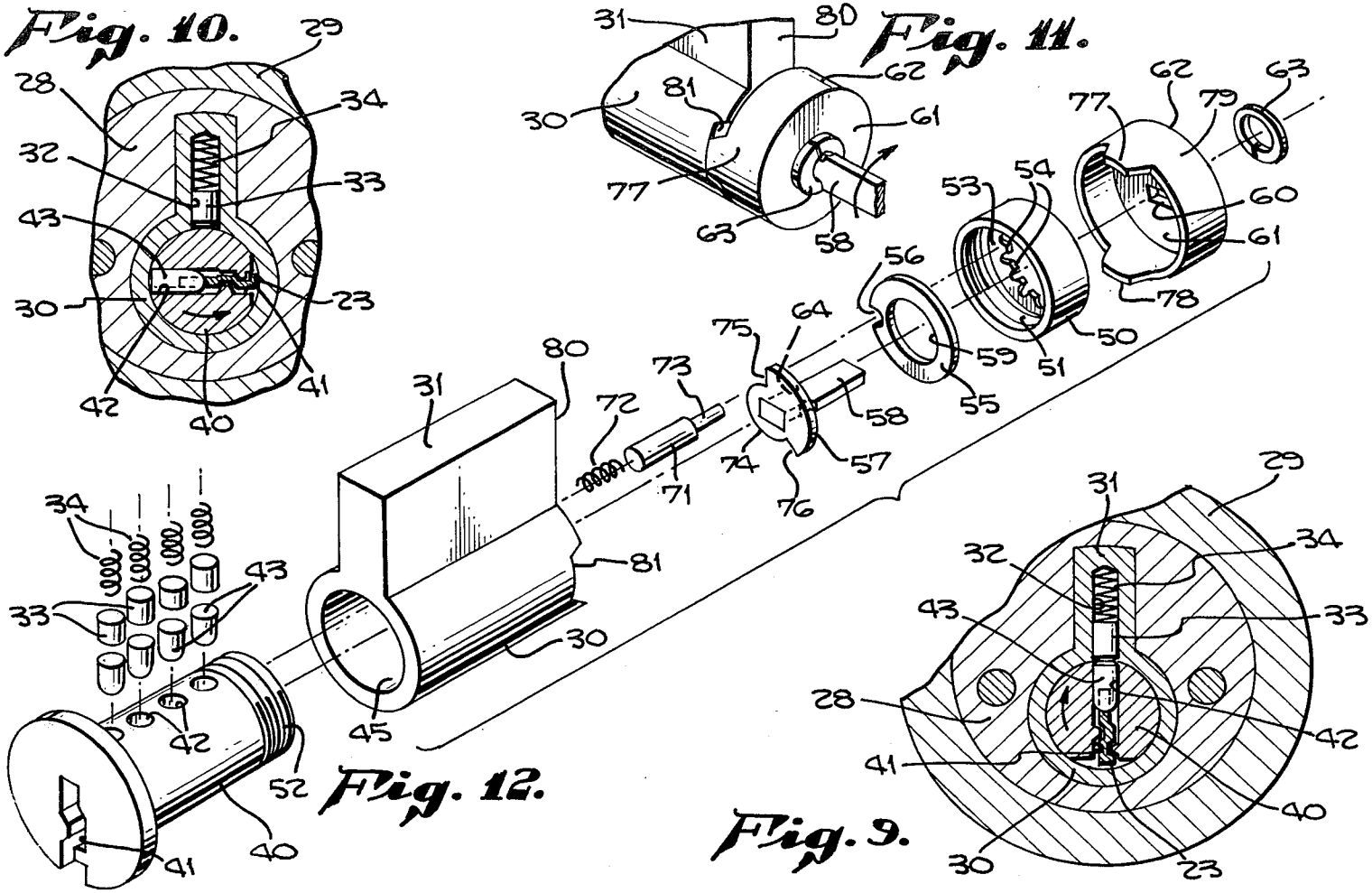
FIG. 9 is a fragmentary cross-sectional view on the line 9—9 of FIG. 6.
FIG. 10 is a fragmentary cross-sectional view similar to FIG. 9 but with the cylinder plug rotated ninety degrees.
FIG. 11 is a fragmentary end perspective view of the cylinder in a position different from FIG. 7.
FIG. 12 is an exploded perspective view of the cylinder, cylinder plug and associated parts.

For the purpose of illustration there is shown in FIG. 1 a fraction of a door 10 on which, merely by way of example, is mounted a conventional latchset 11 and a deadlock 12. An outer knob 13 for the latchset is applied to outer trim 14 mounted on the outside face 15 of the door. On the inside face 16 is an inner knob 17 and its inside trim 18, the latch set being adapted to manipulate a latch bolt 19.

For the deadlock 12 there is an outer trim assembly 20 and an inner trim assembly 21, key operated by use of a key 23 as to both the outer trim and inner trim assemblies for the purpose of manipulating a dead bolt 22.

As shown in further detail in FIG. 2, the door 10 is closed against stop 24 of a door frame 25, there being provided a strike plate 26 in which is a hole 27 for reception of the dead bolt 22.

The inner trim assembly 21 comprises a substantially conventional cylinder housing 28 around which is a guard ring 29. Within the cylinder housing is a cylinder 30 along one side of which projects a flange 31 for accommodation of top pin chambers 32. Within the pin chambers 32 are the customary pins or pin tumblers 33 backed by springs 34.

Within the cylinder 30 is a conventional cylinder plug 40 having a customary keyway 41 for accommodation of the key 23. In the cylinder plug are pin chambers 42 for accommodation of conventional pins or pin tumblers 43. When the pin chambers 32 are in alignment with the pin chambers 42, the respective pins are adapted to be manipulated by appropriate cuts in the key 23 so that when they meet at a shearline 44 the cylinder plug 40 can be rotated within a cylindrical chamber 45 of the cylinder 30. A set screw 46 holds the cylinder 30 within the cylinder housing 28.

For the purpose of the invention, specific parts, as shown in perspective in FIG. 12, are adapted to be attached to the inner end of the cylinder plug 40. For the purpose of attachment, there is provided what may advantageously be termed a micro-cap 50 having interior threads 51 for threaded engagement with exterior threads 52 at the inner end of the cylinder plug 40. An annular flange 53 at one end of the micro-cap is provided with a series of circumferentially spaced recesses 54. Within the micro-cap and adjacent the annular flange 53 is a notched washer 55, at the edge of which is a single notch 56. Extending over the washer 55 is a cam piece 57 to which is anchored a tailpiece 58. The tailpiece 58 is adapted to extend through a hole 59 of the washer 55, thence through the open central portion of the micro-cap 50 and into a rectangular opening 60 of an end wall 61 of a cap 62. A snap ring 63, which engages a shouldered recess 64 of the tailpiece 58, serves to fasten together the assembly consisting of the tailpiece 58 and its cam 57, the washer 55, the micro-cap 50, and the cap 62, the micro-cap 50 having a slidable and rotatable fit within the cap 62.

For manipulation of the cylinder plug in a substantially conventional fashion, there is provided within the cylinder plug a bore 70 which slidably accommodates a pin 71, biased in an outward direction by a coiled spring 72. A reduced outer portion 73 of the pin 71 extends through a cut-out portion 74 of the cam piece 57, thence through the notch 56 and into one or another of the recesses 54 of the micro-cap 50 to hold it in adjustment. The pin 71 is adapted to be urged against one or another of the two cam faces 75, 76, when the cylinder plug 40 is rotated, for the purpose of rotating the tailpiece 58 in one direction or another.

Of special consequence is the provision of cams 77 and 78 in a side wall 79 of the cap 62. Each of the cams 77 and 78 have opposite oblique camways. The cams 77 and 78 are adapted to operate in conjunction with appropriate portions of an inner face 80 of the cylinder 30, serving as a cam complementary to the cams 77 and 78. More particularly there is provided at the inner face 80 recesses 81 and 82, each of which have opposite oblique camways adapted to cam with respect to the oblique sides of the cams 77 and 78.

The outer trim assembly 20 is provided with a substantially conventional key operated mechanism, not shown, but which serves to operate an outer tailpiece 83 in cooperation with the heretofore described inner tailpiece 58. The tailpieces, acting in a conventional manner, rotate an appropriate hub 84 within a housing extension 85 of a dead bolt housing 86. In this manner the dead bolt 22 is extended and withdrawn.

In operation let it be assumed that initially the dead bolt is in withdrawn unlocked position. This is the position depicted in FIGS. 3, 4, and 6. In this position the orientation of the tailpieces 58 and 83 are horizontal. In this position the key 23 may be inserted in the keyway 41 so that conventional cuts on the key adjust the pins 43 so that they coincide with the shear line 44, making it possible to rotate the cylinder plug 40. It should be noted, however, for the purpose of the invention that the cap 62 is in the orientation clearly shown in FIG. 7 such that the cams 77 and 78 ride up on the inner face 80 of the cylinder 30. In that position the end wall 61 of the cap 62 acting against the snap ring 63 and hence the tailpiece 58, serves to hold the cylinder plug 40 in an axial position such that the pin chambers 42 are in alignment with the pin chambers 32.

It should be borne in mind that the direction of rotation to lock and unlock depends on the "door hand", i.e. on which side of the door the lock is mounted. For example, clockwise rotation unlocks a right hand door and counterclockwise rotation unlocks a left hand door.

When the key 23 is rotated in a counterclockwise direction as depicted in FIG. 10, the cylinder plug 40 rotates, rotating with it the pin 71 and its reduced outer portion 73. As the outer portion of the pin 71 is pushed against the cam face 76 of the tailpiece, it causes the tailpiece 58 to be rotated ninety degrees in a counterclockwise direction. This is the rotation which extends the dead bolt 22 to the locked position of FIGS. 5, 8 and 11. What is significant in respect to the invention is that, as shown to good advantage in FIG. 11, the cams 77 and 78 are in released position. In other words, the cams 77 and 78, which are in the nature of projections, are received in the recesses 81 and 82 of the inner face 80 of the cylinder 30. The effect of this is to release axial retention of the cylinder plug by the cap 62 and its wall 61.

Following conventional practice, if the key 23 is to be withdrawn from the keyway 41, the key must be reverse rotated ninety degrees clockwise to initial position, as appearing in FIGS. 6, 8 and 9. This return rotation, without at the same time withdrawing the dead bolt 22, is made possible because of the lost motion arrangement or, as it is sometimes called lazy cam action, resulting from provision of the cut-out portion 74 between the cam faces 75 and 76 on cam piece 57. During this rotation the pin 71 moves freely throughout the cut-out portion, without disturbing the position of the tailpiece 58. Normally, the pin chambers 32 and 42 would be in the alignment of FIG. 6, thus permitting the key 23 to be withdrawn. What happens as a result of the invention is that because the cams 77, 78 are in released position, the cylinder plug 40 is not held in the position of FIG. 6 but is permitted to shift axially from left to right to the position of FIG. 8. As a consequence of this shift, the pin chambers 42 are moved out of alignment with the pin chambers 32. This movement, even though no more than a small fraction of an inch, is sufficient to prevent the pin tumblers 43 from being pushed upwardly by cuts on the key 23 and the key 23 can therefore not be removed. This condition prevails as long as the latch bolt remains in the extended locked position.

To remove the key 23 it is necessary to rotate the key and the cylinder plug 40 further in a clockwise direction, as viewed in FIG. 9, so that the pin 71 then moves against the cam face 75, causing the tailpiece 58 to rotate ninety degrees from the position of FIG. 5 to the position of FIG. 4, the latter being the unlocked position. The final rotation made reference to then causes the cams 77, 78 to ride up into camming position with respect to the inner face of the cylinder, the position of FIG. 7. As has heretofore been described, this adjustment of cams prevents axial shift of the cylinder plug 40. When key 23 and cylinder plug 40 are returned to initial key insert position and the key is pulled in an outward direction, the pin chambers accordingly are held in alignment and the key can then in fact be withdrawn.

On those occasions where the deadlock may be locked by key action of the key 23 applied to the inner trim assembly 21 and there is need to unlock the door from the outside, an identical key 23' may be used to operate the outer trim assembly 20. Because of the lazy cam action referred to previously, the outer tailpiece 83 may be rotated with the hub 84, carrying with it the inner tailpiece 58 until the dead bolt is withdrawn and the tailpieces are returned to the horizontal positions of FIG. 4. This being the unlocked position, the cap 62 will have assumed the cam engaging position of FIG. 7 and, accordingly, the key 23 can be withdrawn from the inner trim 21.

While a particular embodiment of the present invention has been shown and described, it will be obvious to those skilled in the art that changes and modifications may be made without departing from the invention in its broader aspects and, therefore, the aim of its appended claims is to cover all such changes and modifications as fall within the true spirit and scope of the invention.

Having described the invention, what is claimed as new in support of Letters Patent is as follows:

1. A deadlock device including a dead bolt, an inside key actuated mechanism having a tailpiece in operating engagement with the dead bolt for shifting said dead bolt between an extended locked position and a retracted unlocked position, said key actuated mechanism comprising a relatively stationary housing, a cylinder within the housing having a chamber and a cylinder plug rotatably mounted in said chamber and in operating engagement with the tailpiece, complementary pin chambers respectively in said cylinder and said plug adapted for alignment with each other in unlocked position whereby a key can be inserted and withdrawn, the improvement comprising means for effecting detention of the key in said plug when the dead bolt is in locked position and release of the key when the dead bolt is in unlocked position, said means comprising cam means including a relatively rotatable cam element in engagement with said tailpiece and a relatively stationary complementary cam element, said cam elements having positions of mutual engagement in one rotative position of the tailpiece with the dead bolt in unlocked position wherein the pin chambers respectively of said cylinder and said plug are held in longitudinal alignment to permit withdrawal of the key, said cam elements having positions of mutual release in another rotative position of the tailpiece with the dead bolt in locked position enabling longitudinal misalignment of the pin chambers respectively of said cylinder and said plug to prevent withdrawal of the key.

2. A deadlock device as in claim 1 wherein there is a cap in non-rotatable engagement with said tailpiece, said rotatable cam element being on said cap.

3. A deadlock device as in claim 2 wherein there is a limited amount of longitudinal movement between said plug and said cap when said cam elements are in positions of mutual release.

4. A deadlock device as in claim 2 wherein said cap and said tailpiece have an engagement with each other inhibiting relative movement in both a rotational and axial direction.

5. A deadlock device as in claim 1 wherein said relatively stationary cam element comprises a cut-out portion of said cylinder.

6. A deadlock device as in claim 1 wherein there is an inner cap within said first identified cap in fixed engagement with said plug and a pin on said plug in non-rotatable engagement with said inner cap, said plug having a rotational lost motion engagement with said tailpiece.

7. A deadlock device as in claim 1 wherein there is an outside key actuated mechanism having an outside tailpiece in operating engagement with the dead bolt for shifting said dead bolt between said extended locked position and said retracted unlocked position.

* * * * *